United States Patent [19]

Properzi

[11] 3,971,431

[45] July 27, 1976

[54] COOLING DEVICE FOR THE WHEEL OF A CONTINUOUS CASTING MACHINE

[76] Inventor: Giulio Properzi, Via Pietro Cossa, 1, Milan, Italy, 20122

[22] Filed: Nov. 4, 1974

[21] Appl. No.: 520,700

[30] Foreign Application Priority Data

Nov. 12, 1973 Italy ..... 31214/73

[52] U.S. Cl. ..... 164/278; 164/283 MT

[51] Int. Cl.[2] ..... B22D 11/06

[58] Field of Search ..... 239/222.11, 128; 164/87, 276, 277, 278, 283 MT

[56] References Cited

UNITED STATES PATENTS

| | | | |
|---|---|---|---|
| 3,279,000 | 10/1966 | Cofer et al. | 164/277 |
| 3,537,506 | 11/1970 | Griffiths | 164/276 |
| 3,785,428 | 1/1974 | Hazelett et al. | 164/278 |
| 3,800,852 | 4/1974 | Properzi | 164/278 |

*Primary Examiner*—John J. Love
*Assistant Examiner*—Michael Mar
*Attorney, Agent, or Firm*—Guido Modiano; Albert Josif

[57] ABSTRACT

A cooling device for the wheel of a continuous casting machine, which has an annular header disposed internally to the casting ring of the wheel and a plurality of spray nozzles arranged on the header for spraying jets of cooling fluid onto the casting ring and comprises elements for separating the cooling fluid stream, distributed in the space between the inner peripheral surface of the casting ring and the header. The elements define with the peripheral surface and with the header a plurality of independant cooling sections each of which comprises at least one spray nozzle. The separator elements each have at least surfaces close to the peripheral surface of the casting ring and oriented so as to diverge the stream of cooling fluid into directions having opposite components transverse to the circumferential direction of flow of the cooling fluid on the peripheral surface of the casting ring during the rotation of the casting ring.

4 Claims, 5 Drawing Figures

COOLING DEVICE FOR THE WHEEL OF A CONTINUOUS CASTING MACHINE

BACKGROUND OF THE INVENTION

This invention relates to a cooling device for the wheel of a continuous casting machine of the wheel and belt type, comprising an annular header disposed internally to the casting ring of the wheel and a plurality of spray nozzles arranged on the header for spraying jets of cooling fluid onto the casting ring.

The performance limits of a continuous casting machine in terms of production rate and metal quality are determined by the characteristics of the cooling system.

In a continuous casting machine of the wheel and band type, an ingot of indefinite length is produced by feeding the molten metal into the mould defined by the channelled ring of the casting wheel and the metal band which embraces said ring through a certain arc, cooling the metal during the wheel rotation and extracting it from the channel when it has reached a sufficient degree of cohesion. It is therefore necessary for the metal to reach a sufficiently low temperature, i.e. a degree of cohesion sufficient for extracting the ingot from the channel without breakage or dangerous bending, within less than one revolution of the wheel, so that the channel is ready to receive new molten metal.

The cooling rate, i.e. the quantity of heat which the cooling fluid is able to remove from the metal in unit time, imposes a maximum value on the rotational speed of the wheel, which is the parameter which determines the production rate.

Thus to attain high production rates, the heat exchange between the solidifying metal and the cooling fluid must be raised to a maximum.

As already stated, a further problem which depends on the characteristics of the cooling system is the quality optimisation of the metal produced. In this respect, the metal must pass from the liquid state to the solid state not only in the shortest possible time, but also in a regular and uniform manner, as the manner in which this passage of state takes place considerably influences the characteristics of the internal structure of the metal and therefore its mechanical and electrical characteristics. A cooling process of maximum rapidity, as would be desirable for increasing the production rate, may however have negative effects on the passage of state of the metal in the sense of not allowing the formation of the optimum crystalline structure.

Thus the efficient, properly gauged and most of all uniform cooling of the inner surface of the ring and metal band is essential in order to obtain an optimum metal quality and a high production rate.

The attempts made up to the present time to obtain rapid and uniform cooling in a casting wheel comprise numerous methods.

The most conventional method for cooling the ring of a casting wheel and the metal contained in it comprises passing cooling fluid into ducts of small cross-section formed in the bulk of the ring. This method creates a serious problem in the attempt to obtain a high heat transfer rate between the ring and cooling fluid. This is because the temperature of the ring, particularly in the zone where the molten metal is received, may reach such high values that the layer of coolant adhering to the surfaces of the ducts may vaporise, so considerably increasing the resistance to heat passage between the walls of the duct and the coolant, and therefore the heat exchange. Furthermore, the fact that the ducts are divided into groups along the periphery of the ring leads to non-uniform cooling, resulting in the said crystallization defects, and the prevention of a high cooling rate to the detriment both of the production rate and the ring life.

Attempts to overcome these disadvantages have led to the construction of a device for continuously feeding jets of coolant onto the inner surface of the casting ring. This device consists of a non-rotating annular header, concentric and internal to the ring, and comprising on the surface facing the ring a series of spray nozzles of adjustable flow rate. Cooling of good uniformity can be obtained with this device, if the jets are carefully regulated. However this system also has limitations.

In these devices, because of the closeness of the spray nozzles, as is required to obtain the most uniform cooling possible, and the turbulence created by the impact of the jets on the ring surface, there is a partial permanence of hot fluid on the ring inner surface. Even though this hot fluid becomes partially replaced by cold fluid, the phenomenon is continuous and this leads to a considerable limitation in the efficiency and rapidity of heat transfer, which limits the maximum allowable rotational speed of the casting wheel and hence its production rate. Furthermore this phenomenon can lead to a certain non-uniformity of cooling of the ring surface, which negatively influences the internal metal structure.

SUMMARY OF THE INVENTION

The object of this invention is to provide a cooling device for the casting ring of a continuous casting machine, which gives rapid and uniform heat transfer from the casting ring, and therefore from the solidifying metal contained in it, to the cooling fluid, so allowing increased rotational speeds of the wheel to be obtained, and therefore an increase in production rate and an improved metal quality with respect to those obtainable in machines provided with current cooling devices.

This object is attained according to the invention by a cooling device of the type initially specified, comprising elements for separating the cooling fluid stream, distributed in the space between the inner peripheral surface of the casting ring and the header, and defining with said peripheral surface and said header a plurality of independent cooling sections each comprising at least one spray nozzle, said separator elements each having at least surfaces close to said peripheral surface orientated so as to diverge the stream of cooling fluid into directions having opposite components transverse to the circumferential direction of flow of the cooling fluid on the said peripheral surface during the rotation of said casting ring.

Advantageously said separator elements consist of deviator or dividing plates formed from thin metal sheets connected at one end to the header carrying the spray nozzles and shaped at their other end so as to perfectly match with the inner peripheral surface of the casting ring, said sheets having one face arranged to feed the cooling fluid from the spray nozzles towards the ring surface and an opposing face arranged to remove from the ring surface the heated cooling fluid originating from the spray nozzles situated upstream and dragged by the rotating casting ring.

A structure of this type enables rapid and uniform dispersion of heat to be obtained by dispersing that fluid generated by the spray nozzles which has already skimmed the hot ring surface and has reached a temperature which prevents heat transfer at the required rate.

In this respect, the speed of the fluid running over the surface of the ring diminishes because of the obstacle represented by the separator element which closes the cooling section and prevents passage from one section to another, until it is almost zero, its kinetic energy being transformed into a rise in level immediately upstream of the obstacle, until a sufficient level is obtained to overcome the lateral shoulders of the casting ring, the fluid then overflowing out of the wheel through suitable paths formed in the supporting structure, without interfering with the stream of the next section.

A typical cooling section is therefore bounded by the outer surface of the header, the inner surface of the casting ring and two successive separator elements fixed to the header and which give good fluid seal by sliding contact on the inner surface of the ring, said section being fed with cold fluid by the spray nozzles lying between said dividing plates. The various independent sections each form a self-sufficient cooling circuit.

By permitting continuous cooling fluid exchange, resulting in an average temperature of the inner ring surface which is considerably less than that obtainable by a traditional device, a cooling device conceived in this manner ensures a high rate of heat transfer and therefore high production rates, and at the same time helps to increase the life of the material of the ring, said life being notably an inverse function of the average material temperature.

Furthermore said sectional cooling device provides optimum uniformity of heat transfer, which is a factor determining the metal quality and therefore the characteristics of the crystalline structure. In this respect, the small thickness of the deviators does not lead to substantial interruption of cooling continuity, and the rapid fluid dispersion prevents partial permanence of hot fluid on the ring surface, which as stated creates non-uniformly cooled zones.

According to a further preferred embodiment of the invention, the deviator plates are of substantially V cross-section with the vertex facing the arriving stream. This permits efficient separation of the stream from the ring surface and its consequent removal without causing turbulence or other flow impediments.

Advantageously the deviator plates may be mounted inclined to the normal at their points of fixing to the header, the inclination being such that the face arranged for removing the heated fluid forms an acute angle with the inner ring surface, and the face arranged to guide the cold fluid ejected by the spray nozzles forms an obtuse angle with the ring surface. The inclination prevents zones from not being reached by the cooling fluid and contributes to cooling uniformity.

According to a further embodiment of the invention, the deviator plates are disposed hinged at one end to the header carrying the spray nozzles and elastic members are provided for pressing the deviator plates against the inner peripheral surface of the casting ring, so giving the most complete separation between one cooling section and another.

BRIEF DESCRIPTION OF THE DRAWINGS

Further characteristics and advantages of the invention will be more evident from the description of a preferred but not exclusive embodiment of a cooling device according to the invention, illustrated by way of example in the accompanying drawing in which.

DESCRIPTION OF THE PREFERRED EMBODIMENT

Figure 5:
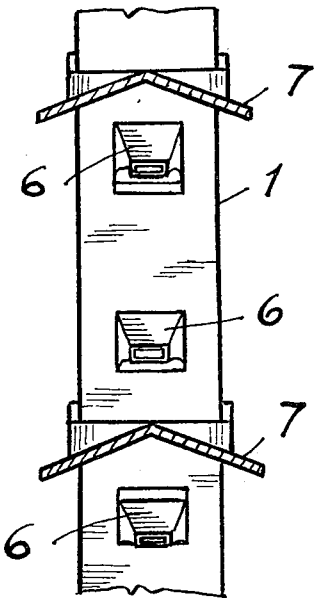
FIG. 5 is a section on the line V—V of FIG. 4.
Figure 4:
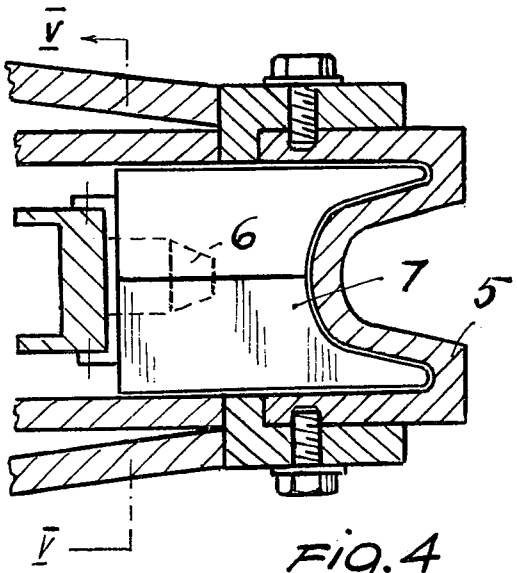
FIG. 4 is a section on the line IV—IV of FIG. 2.
Figure 1:
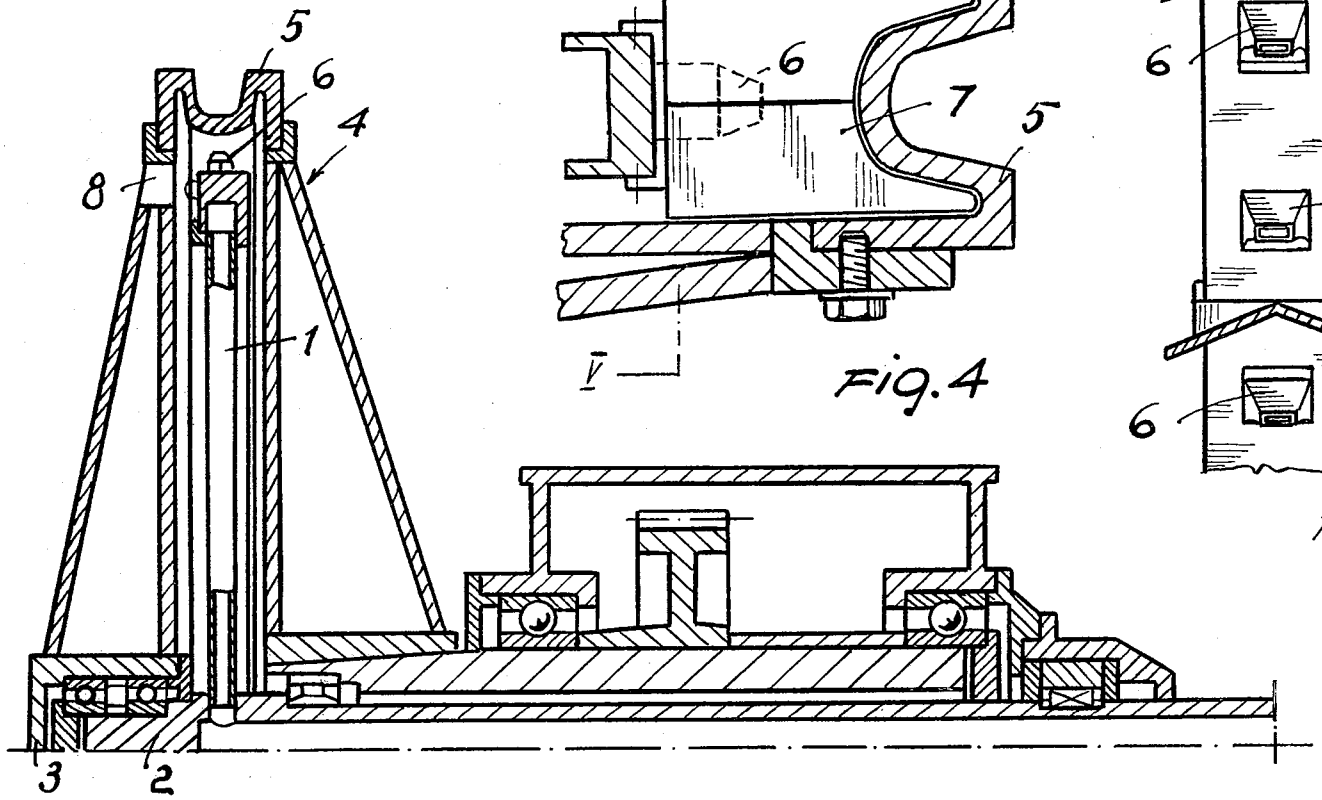
FIG. 1 is a section on a plane passing through the axis of rotation of a casting wheel provided with the cooling device according to the invention.

With reference to the said figures, the cooling device according to the invention comprises an annular header 1 for the cooling liquid connected in a non-removable manner to the fixed support 2 of the drive shaft 3 of the casting wheel 4, which peripherally carries the casting ring 5.

The header 1, disposed internally and concentric to the casting ring 5, comprises on its periphery a plurality of spray nozzles 6 which direct their jets onto the inner peripheral surface of the casting ring 5, preferably in a direction inclined to the normal at the point of impact.

Guiding and separating elements for the cooling fluid stream are disposed in spaced relationship in the space between the inner peripheral surface of the casting ring and the header 1, and consist of deviator plates 7 connected at one end to the header 1 by connecting fins. The distances between the deviator or dividing plates 7 is such that at least one spray nozzle 6 lies between two successive plates. The deviator plates 7 are disposed preferably inclined to the internal peripheral surface of the ring 5, the inclination being in the same direction as the inclination of the jets from the spray nozzles 6 and increased in extent so that there is always one spray nozzle spraying its cooling jet onto that surface of the deviator plate 7 which forms an obtuse angle with the inner surface of the ring 5.

Figures 2, 3:
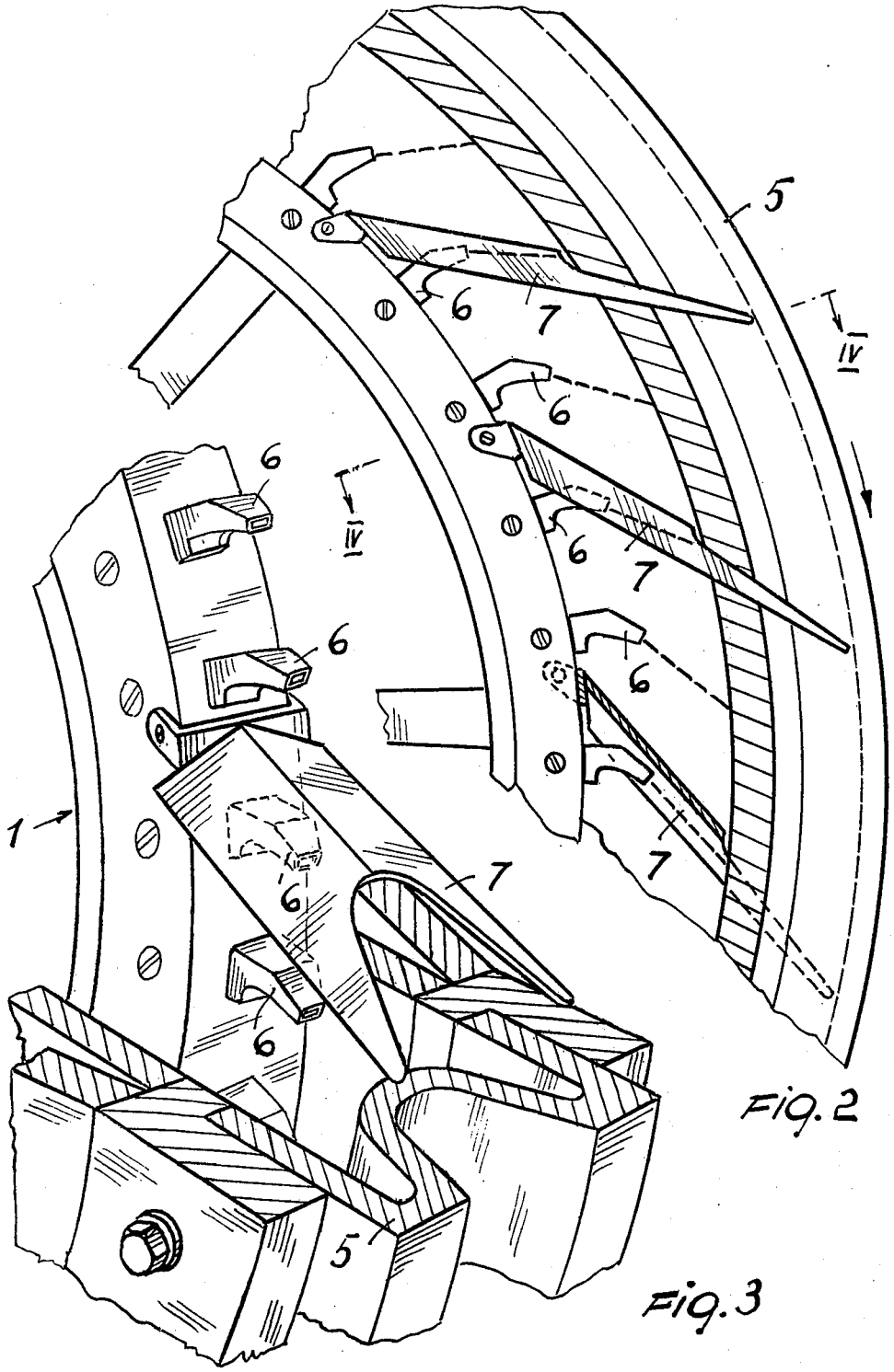
FIG. 2 is a partially sectional front view of a portion of the cooling device and casting ring.
FIG. 3 is a perspective view of a portion of the cooling device and a length of the casting ring.

The configuration of the deviator plate, as shown in the drawings, is such that the surface thereof receiving cooling fluid from a nozzle feeds the cooling fluid substantially circumferentially onto the internal peripheral surface of the casting ring 5 and the opposite surface removes the stream of cooling fluid from the internal peripheral surface of the casting ring. Moreover the deviator plate is shaped so as to perfectly match with the inner surface of the ring, so as to adhere to it by sliding, and a spring or equivalent resilient means may also be provided for further pressing the deviator plate against the ring. In this way no heated cooling fluid can pass beyond the deviator plate into the next cooling section and the stream of heated cooling fluid, as deducible when considering particularly FIGS. 2 and 3, is deviated by the diverging portions of each deviator plate from its original circumferential direction into directions having a component transverse to the circumferential direction, that is into directions leading to the sides of the casting ring. The deviator plates 7 consist preferably of thin metal sheet members hinged to the header 1 and having a cross-section substantially in the form of a very wide open V, their assembly being such that the vertex faces the arriving stream to favour the formation of the fluid vein and the separation of said vein from the inner ring surface by diverging it into directions having opposite components transverse to the circumferential extension of the casting ring.

From the description it is evident that the combined use of the spray nozzles and deviator plates shaped and disposed as heretofore described enables the entire zone cooled by the sprays to be divided into numerous self-sufficient cooling circuits, each bounded by two successive plates, without interrupting cooling uniformity because of the small thickness of the material which forms the deviator plates.

The cooling fluid sprayed by the spray nozzles lying between two successive plates, after lapping the inner surface of the ring uniformly at every point and therefore after absorbing heat, is removed by that face of the deviator closing the considered section, which forms an acute angle with the ring surface.

The heated cooling fluid is expelled from the casting wheel by suitable openings 8 formed in the wheel support structure. The number of spray nozzles and the number of deviator plates and their spacing on the header 1 may be chosen in each individual section so as to obtain cooling optimisation.

Thus not only high cooling efficiency is obtained, but also optimum cooling uniformity with all those benefits already examined.

The invention so conceived is susceptible to numerous modifications, all of which fall within the scope of the inventive idea. Furthermore all details may be replaced by other equivalent elements, and in practice the materials used and dimensions may be chosen according to requirements.

I claim:

1. A cooling device for a continuous casting machine of the wheel and belt type having a casting wheel comprising a casting ring thereon defining with said belt a mold for the metal to be cast, the device comprising an annular header arranged internally to said casting ring, a plurality of spray nozzles arranged on said header for spraying cooling fluid onto the internal peripheral surface of said casting ring, cooling fluid guiding and separating elements arranged in spaced relationship in the space between said internal peripheral surface of said casting ring and said header and defining with said peripheral surface and said header a plurality of independent cooling sections each including at least one of said spray nozzles, said elements each comprising a metal sheet member connected at one end to said header and shaped at the other end so as to perfectly match with said internal peripheral surface of said casting ring, said sheet member having one face arranged to feed the sprayed cooling fluid substantially circumferentially onto said internal peripheral surface and an opposite face having portions arranged to diverge the oncoming stream of heated cooling fluid fed by upstream arranged spray nozzles into directions having opposite components transverse to the circumferential direction of flow of the cooling fluid on said internal peripheral surface of said casting ring.

2. A cooling device for a continuous casting machine of the wheel and belt type having a casting wheel comprising a casting ring thereon defining with said belt a mold for the metal to be cast, the device comprising an annular header arranged internally to said casting ring, a plurality of spray nozzles arranged on said header for spraying cooling fluid onto the internal peripheral surface of said casting ring, cooling fluid guiding and separating elements arranged in spaced relationship in the space between said internal peripheral surface of said casting ring and said header and defining with said peripheral surface and said header a plurality of independent cooling sections each including at least one of said spray nozzles, said elements each comprising a metal sheet member connected at one end to said header and shaped at the other end so as to perfectly match with said internal peripheral surface of said casting ring, said sheet member having one face arranged to feed the sprayed cooling fluid substantially circumferentially onto said internal peripheral surface and an opposite face arranged to remove the heated cooling fluid originating from the spray nozzles arranged upstream and circumferentially flowing on said internal peripheral surface of said casting ring, wherein said sheet member comprises a plate having a substantially V-shaped cross-section with the vertex thereof facing the oncoming cooling fluid stream.

3. A device as claimed in claim 2, wherein said elements are mounted inclined with respect to said internal peripheral surface such that the face arranged to remove the heated fluid forms an acute angle with said inner peripheral surface of said casting ring, and the face arranged to feed the cold fluid ejected by the spray nozzles forms an obtuse angle with said inner peripheral surface.

4. A device as claimed in claim 2, comprising cooling fluid guiding and separating elements hinged at one end to said header and resilient means for pressing said elements against said inner peripheral surface of said casting ring.

* * * * *